US008602272B2

(12) United States Patent
Burel et al.

(10) Patent No.: US 8,602,272 B2
(45) Date of Patent: Dec. 10, 2013

(54) AEROSOL METERING VALVE AND DEVICE FOR DISPENSING A FLUID MATERIAL COMPRISING SUCH A VALVE

(75) Inventors: Stephane Burel, Villez Sous Bailleul (FR); Frederic Pirou, Crasville (FR); Matthieu Savalle, Rouen (FR)

(73) Assignee: Aptar France SAS, Le Neubourg (FR)

( * ) Notice: Subject to any disclaimer, the term of this patent is extended or adjusted under 35 U.S.C. 154(b) by 0 days.

(21) Appl. No.: 13/379,939

(22) PCT Filed: Jun. 18, 2010

(86) PCT No.: PCT/FR2010/051228

§ 371 (c)(1),
(2), (4) Date: Mar. 19, 2012

(87) PCT Pub. No.: WO2010/149906

PCT Pub. Date: Dec. 29, 2010

(65) Prior Publication Data

US 2012/0160878 A1 Jun. 28, 2012

(30) Foreign Application Priority Data

Jun. 22, 2009 (FR) ..... 09 54221

(51) Int. Cl.
*B65D 83/00* (2006.01)

(52) U.S. Cl.
USPC ..... 222/402.2; 222/246

(58) Field of Classification Search
USPC ..... 222/402.2, 402.1, 401, 402, 402.13, 222/402.24, 402.21–402.25, 190, 243, 246
See application file for complete search history.

(56) References Cited

U.S. PATENT DOCUMENTS

| | | | | |
|---|---|---|---|---|
| 3,184,118 | A * | 5/1965 | Webster | 222/189.1 |
| 4,415,099 | A * | 11/1983 | Paris | 222/95 |
| 4,978,038 | A * | 12/1990 | Sullivan | 222/402.19 |
| 5,593,069 | A | 1/1997 | Jinks | |
| 8,066,682 | B2 * | 11/2011 | Kimura et al. | 604/298 |
| 8,286,941 | B2 * | 10/2012 | Fontela et al. | 251/354 |
| 2009/0008584 | A1 | 1/2009 | Fontela et al. | |

FOREIGN PATENT DOCUMENTS

| | | | |
|---|---|---|---|
| FR | 1598257 | A | 7/1970 |
| JP | 2000-197837 | A | 7/2000 |
| JP | 2001-114360 | A | 4/2001 |
| JP | 2004-275909 | A | 10/2004 |
| WO | WO 2007/074274 | A1 | 7/2007 |

* cited by examiner

*Primary Examiner* — Lien Ngo
(74) *Attorney, Agent, or Firm* — Sughrue Mion, PLLC

(57) ABSTRACT

An aerosol metering valve (20) comprising: a valve body (21) containing a metering chamber (25) defined between an upper gasket (251) and a lower gasket (252); a valve member (30) that slides in leaktight manner against said upper and lower gaskets (251, 252) in said metering chamber (25); said metering chamber (25) including at least one movable element (100) that moves freely in said metering chamber (25), said at least one movable element being of shape that is substantially spherical, such as a ball.

12 Claims, 1 Drawing Sheet

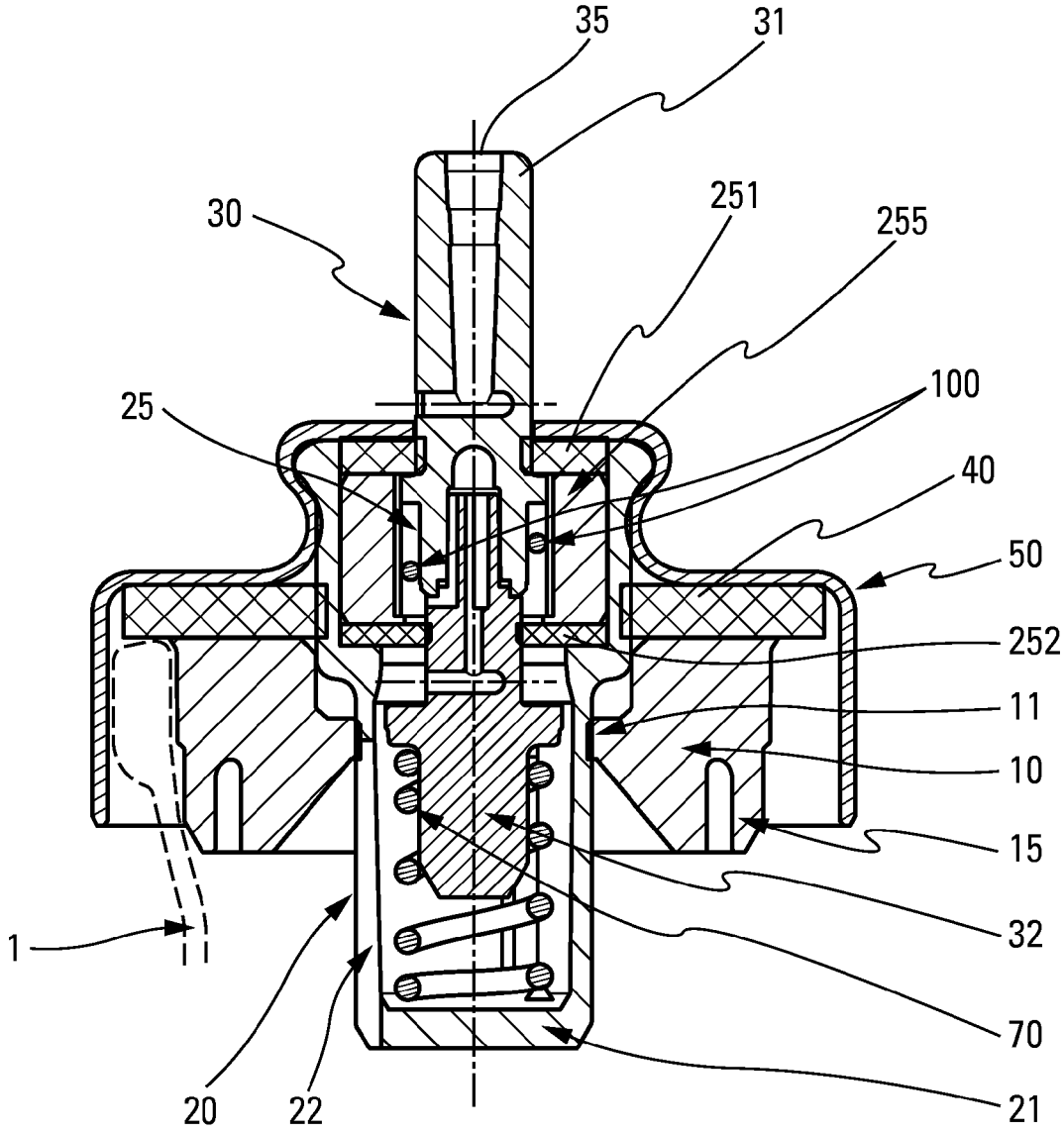
35
31
30
251
255
100
25
40
50
252
11
10
15
32
1
70
20
22
21

AEROSOL METERING VALVE AND DEVICE FOR DISPENSING A FLUID MATERIAL COMPRISING SUCH A VALVE

The present invention relates to an aerosol metering valve and to a fluid dispenser device including such a valve.

It is known to use aerosol dispenser valves, in particular metering valves, for dispensing successive doses of drugs, generally in the form of micronized powders containing active principles mixed with propellant gases, generally of the hexafluoro acetone (HFA) type, e.g. HFA-134a and/or HFA-227. Such metering valves are generally used upsidedown, with the reservoir above the valve during use, and they include a metering chamber that is filled by gravity. When the period of storage between two actuations is fairly long, the accuracy of metering may be reduced, in particular because of phenomena of the active principles(s) sticking to the walls of the metering chamber and/or of the active principle(s) sedimenting or creaming. This results in a loss of uniformity in the doses that are dispensed, and poor metering reproducibility between a plurality of successive actuations. Unfortunately, depending on the drugs to be dispensed, it is generally desirable to optimize both metering reproducibility (same dose of active principles to be dispensed on each actuation) and uniformity of the dose (good distribution of the active principles in the dose to be dispensed) so as to provide maximum effectiveness of the dose for the user. In order to overcome this problem, it has been proposed to provide a ring in the metering chamber, which ring is movable about the valve member so as to homogenize the dose by shaking the device. Documents U.S. Pat. No. 5,593,069, JP 2000 197837, and JP 2001 114630 describe devices of that type. However, rings present drawbacks. In particular, they have inertia that makes them difficult to move, in particular for children or elderly people. In addition, they may retain the fluid because of their large outside are, thereby limiting the beneficial effect on dose reproducibility.

An object of the present invention is to provide an aerosol dispenser valve that does not have the above-mentioned drawbacks.

More particularly, an object of the present invention is to provide an aerosol dispenser valve that reduces the Loss of Dose (LOD) phenomenon between two successive actuations, even after a long period of storage.

Another object of the present invention is to provide such a valve that makes it possible to optimize the dispensing performance of the valve, in particular by optimizing the quantity of active principles that are dispensed on each actuation.

Another object of the present invention is to provide such a valve that is simple and inexpensive to manufacture and to assemble.

The present invention thus provides an aerosol metering valve for dispensing fluid, the valve comprising: a valve body containing a metering chamber defined between an upper gasket and a lower gasket; a valve member that slides in leaktight manner against said upper and lower gaskets in said metering chamber; said metering chamber including at least one movable element that moves freely in said metering chamber, said at least one movable element being of shape that is spherical, such as a ball.

Advantageously, said at least one movable element is of density that is high relative to the density of the fluid contained in said metering chamber, and of dimensions that are small relative to the dimensions of said metering chamber.

Advantageously, said metering chamber includes a plurality of movable elements, in particular two or three.

Advantageously, the reproducibility of the dose between two successive actuations, namely the quantity of active principles to be dispensed during the second actuation compared to the quantity of active principles to be dispensed during the first actuation, is greater than 80%, advantageously greater than 85%, preferably greater than or equal to 90%.

In a variant, said metering chamber includes axial channels, each containing at least one movable element, in particular in the form of a ball.

The present invention also provides a fluid dispenser device comprising a reservoir, and comprising a valve as described above.

Advantageously, said valve is assembled on said reservoir by means of a fastener element, such as a crimping cap.

Advantageously, a ring is assembled around said valve body, said ring comprising an inner portion that is rigid and that co-operates with the valve body, and an outer portion that is radially deformable.

Advantageously, said fluid includes one or more active principles in the form of micronized powder mixed with propellant gases, in particular of the HFA-134a and/or HFA-227 type, possibly in the presence of one or more excipients.

These characteristics and advantages and others of the present invention appear more clearly from the following detailed description, given by way of non-limiting example, and with reference to the accompanying drawings, and in which FIG. 1 is a diagrammatic section view of an aerosol dispenser device in its upright position, in an advantageous embodiment of the present invention.

With reference to FIG. 1, the aerosol device includes a reservoir 1 containing the fluid to be dispensed, with only a portion of its neck being represented by dashed lines in FIG. 1. The fluid may be of the pharmaceutical type, and propellant gas, in particular of the HFA type, may be provided for dispensing the fluid through an aerosol valve 20, preferably a metering valve. One or more excipients may also be added to the mixture, if necessary.

The aerosol valve includes a valve body 21 in which there slides a valve member 30, preferably formed by a valve member top 31 that incorporates the outlet orifice 35 of the valve member, and by a valve member bottom 32 that co-operates with a spring 70 that urges the valve member 30 towards its rest position shown in FIG. 1. Advantageously, said valve member top 31 is interfitted on said valve member bottom 32.

The valve body 21 is assembled on the neck of the reservoir 1 by means of a fastener hoop or cap 50, in particular of the crimpable type, preferably with a neck gasket 40 interposed therebetween for sealing purposes.

In particular, the valve shown is for being used upsidedown, i.e. while a dose is being expelled, the valve is situated below the reservoir. However, the valve could also be a valve suitable for use in the on-top position. The valve body would then be fitted with a tube for bringing the liquid to the chamber via the valve body.

The valve body 21 includes one or more openings 22 making it possible to fill the valve with fluid from the reservoir. The openings are shown in the form of lateral longitudinal slots 22 that extend over a portion of the height of the valve body 21. In a variant, one or more openings of different shapes could be provided for this purpose.

The valve body 21 contains a metering chamber 25, typically defined between an upper gasket 251 and a lower gasket 252 against which the valve member 30 slides in leaktight manner. The metering chamber 25 may also be defined by a hollow insert 255 that is arranged in the valve body 21 between said upper and lower gaskets 251 and 252, as shown in FIG. 1.

A ring 10 may be assembled around the valve body 21. The ring 10 is mainly for performing two functions, namely firstly ensuring that the reservoir is emptied as much as possible by limiting, as much as possible, the dead volume situated below the bottom edge of the opening(s) 22 of the valve body 21 when the valve is in its upsidedown working position. Secondly, the ring also serves to limit, as much as possible, contact between the neck gasket 40 and the fluid contained in the reservoir 1. Advantageously, the ring may prevent any contact between the fluid and the neck gasket 40 by forming a seal with a portion of the reservoir after the cap 50 has been crimped. The ring 10 may include at least an inner portion 11 that is for co-operating with the valve body 21, and at least an outer portion 15, preferably a radially outermost portion, that may include a deformable axial wall portion that is capable of elastically deforming radially inwards. In particular, the purpose of the deformable wall is to compensate for, and to absorb, possible radial stresses that could be exerted thereon by the reservoir 1, in particular while the fastener cap 50 is being crimped, said wall deforms radially inwards. A ring of this type is described in greater detail in document WO 2007/074274.

In the invention, the metering chamber 25 contains at least one movable element 100. In the embodiment in FIG. 1, there are two movable elements of spherical shape, such as balls, but any number of movable elements, in particular three, and movable elements of shapes that are similar, e.g. ovoid, may be envisaged. The spherical (or ovoid) shape is advantageous, in particular so as to make it easier to move in the filled metering chamber, and so as to avoid any risk of the fluid sticking to said movable element. The presence of at least one movable element in the metering chamber makes it possible to improve the performance of the valve substantially, in particular by decreasing the LOD phenomenon. Advantageously, said at least one movable element is formed of a high-density ball that is capable of moving freely in the metering chamber 25. The high density is desirable so as to enable the ball to be able to move effectively in the mixture of the active principle(s), the propellant gas(es), and the excipient(s) that is present in the metering chamber. Naturally, the dimensions of the ball(s) are adapted as a function of requirements, and metering chambers of greater volume enable the use of balls of greater diameter. However, since the purpose is to enable the balls to unstick any lumps of powder that might have stuck to the walls or to the gaskets, the use of a plurality of relatively small or dense balls is preferred. The invention thus makes it possible to improve the uniformity of the active-principle content of devices such as pressurized Metered Dose Inhalers (pMDI), this uniformity being one of the main problems with retention metering chambers. Prior to taking a dose, the patient should shake the inhaler so that the content of the reservoir becomes thoroughly mixed since there is both a gas phase and a liquid phase. However, in the metering chamber, there is only a small volume of liquid, and this limits the possibilities for movement. The addition of one or more balls moving in the metering chamber while the inhaler is being shaken makes it possible to mix the formulation more effectively, by creating shear movements. In a variant, the metering chamber could be formed of a plurality of metering channels that extend axially, each containing one or more balls. Other variants may also be envisaged.

The LOD is determined by measuring the quantity of active principle(s) that is not delivered during the expulsion of the dose from a metering valve, after a period of storage. This non-advantageous effect requires the number of times the patient actuates the valve to be increased in order to reach the recommended dosage. Generally, dosages (e.g. for corticosteroids or bronchodilators) indicate taking the drug in two puffs. Most formulations are constituted by one or more HFA propellant gases mixed with one or more active principles in the form of micronized powders, and possibly with one or more excipients. A physical consequence is the sedimentation or the creaming of the active principle(s) during periods of storage. The LOD effect is associated very strongly with the retention and adhesion problems of the active principle(s) in the metering chamber 25 of the valve. By means of one or more movable elements, the invention makes it possible:

- to agitate the fluids in the metering chamber 25 turbulently, so as to homogenize the dispersion of the active principle(s) in the formulation; and/or
- to apply shocks to the wall of the metering chamber mechanically, making it possible to limit the degree to which the active principle(s) stick to the walls and the gaskets.

The table below indicates the percentages of active principle that are dispensed during two successive actuations of a single valve, the two actuations being separated by a period of storage (respectively 8 hours (h), 24 h, 96 h). The percentages are calculated on the bases of a ratio between the quantity of active principle of the second puff compared to the quantity of active principle of the first puff, after said period of storage. Thus, they make it possible to determine the LOD. The higher the ratio, the lower the LOD. The formulation used includes HFA 227+budesonide+excipients. The standard RCS valve is a standard metering valve without balls, and the RCS valve with balls is a metering valve with three balls. Either way, the valve is shaken prior to being actuated. It should be observed that the presence of the balls makes it possible to increase substantially the amount of active principle to be dispensed, and thus to decrease significantly the LOD effect.

| | Percentages of active principle dispensed | |
|---|---|---|
| | Standard RCS valve | RCS valve with balls |
| 8 h storage | 72% | 90% |
| 24 h storage | 79% | 87% |
| 96 h storage | 76% | 84% |

It should be observed that maximum effectiveness is obtained by shaking the valve prior to actuating it, with the effect that the ball(s) act firstly on any sticking of active principles, and secondly to homogenize the dose in the metering chamber. Nevertheless, in particular for devices used in the upsidedown position and stored in the upright position, the mere fact of turning the valve over may suffice for the ball(s) to act in the metering chamber.

Although the present invention is described above with reference to a variant embodiment thereof, as shown in the drawing, the invention is naturally not limited to that variant, but, on the contrary, any useful modifications could be applied thereto by the person skilled in the art. In particular, the valve could be of any structure. In addition, the shapes of the valve body and of the openings could be different from the shapes shown. The same applies to the reservoir, and in particular to its neck, and to the fastener hoop or cap that could be made differently, e.g. by snap-fastening or screw-fastening. In general, any modification is possible without going beyond the ambit of the present invention as defined by the accompanying claims.

The invention claimed is:

1. An aerosol metering valve for dispensing fluid, the valve comprising: a valve body containing a metering chamber defined between an upper gasket and a lower gasket; a valve member that slides in leaktight manner against said upper and lower gaskets in said metering chamber; wherein said metering chamber includes movable elements that moves freely in said metering chamber, said movable elements being of shape that is substantially spherical and wherein said metering chamber includes axial channels, each containing at least one of the spherical movable elements.

2. The valve according to claim 1, wherein each of said movable elements is of density that is high relative to the density of the fluid contained in said metering chamber, and of dimensions that are small relative to the dimensions of said metering chamber.

3. The valve according to claim 1, wherein said metering chamber includes at least three of said movable elements.

4. The valve according to claim 1, wherein the reproducibility of the dose between two successive actuations, namely the quantity of active principles to be dispensed during the second actuation compared to the quantity of active principles to be dispensed during the first actuation, is greater than 80%.

5. A fluid dispenser device including a reservoir, the device being characterized in that it includes a valve according to any preceding claim.

6. The device according to claim 5, wherein said valve is assembled on said reservoir by a fastener element.

7. The device according to claim 5, wherein a ring is assembled around said valve body, said ring comprising an inner portion that is rigid and that co-operates with the valve body, and an outer portion that is radially deformable.

8. The device according to claim 1, wherein said fluid includes one or more active principles in the form of micronized powder mixed with propellant gases.

9. The valve according to claim 1, wherein the reproducibility of the dose between two successive actuations, namely the quantity of active principles to be dispensed during the second actuation compared to the quantity of active principles to be dispensed during the first actuation, is greater than 85%.

10. The valve according to claim 1, wherein the reproducibility of the dose between two successive actuations, namely the quantity of active principles to be dispensed during the second actuation compared to the quantity of active principles to be dispensed during the first actuation, is greater than 90%.

11. The device according to claim 5, wherein said valve is assembled on said reservoir by a crimping cap.

12. The device according to claim 1, wherein said fluid includes one or more active principles in the form of micronized powder mixed with propellant gas of the HFA-134a and/or HFA-227 type and in the presence of one or more excipients.

* * * * *